US010989452B2

(12) United States Patent
Moore

(10) Patent No.: US 10,989,452 B2
(45) Date of Patent: Apr. 27, 2021

(54) CHANNELED CONDENSER BALLAST

(71) Applicant: Carrier Corporation, Palm Beach Gardens, FL (US)

(72) Inventor: Bryce Kirk Moore, Broomfield, CO (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 108 days.

(21) Appl. No.: 16/239,066

(22) Filed: Jan. 3, 2019

(65) Prior Publication Data

US 2019/0203985 A1 Jul. 4, 2019

Related U.S. Application Data

(60) Provisional application No. 62/613,261, filed on Jan. 3, 2018.

(51) Int. Cl.
*F25B 39/04* (2006.01)
*F28F 9/00* (2006.01)
(Continued)

(52) U.S. Cl.
CPC ..... *F25B 39/04* (2013.01); *F28D 7/16* (2013.01); *F28F 9/005* (2013.01);
(Continued)

(58) Field of Classification Search
CPC ..... F25B 39/04; F25B 2339/046; F25B 2339/044; F25B 2600/05; F25B 2400/16; F25B 2500/01; F25B 2339/047; F28F 9/005; F28D 7/16; F28D 2021/007; F24F 13/30
(Continued)

(56) References Cited

U.S. PATENT DOCUMENTS 1,855,390 A 4/1932 Ehrhart
2,830,797 A 4/1958 Garland
(Continued)

FOREIGN PATENT DOCUMENTS

DE 2422168 A1 11/1975
GB 534748 3/1950
(Continued)

OTHER PUBLICATIONS

European Search Report Issued in EP Application No. 19150090.9, dated May 23, 2019, 71 Pages.

*Primary Examiner* — Steve S Tanenbaum
(74) *Attorney, Agent, or Firm* — Cantor Colburn LLP

(57) ABSTRACT

A condenser for a heating, ventilation, air conditioning and refrigeration system includes a condenser shell, a refrigerant inlet located at the condenser shell, and a condenser drain located at the condenser shell. A condenser tube bundle is located in the condenser shell such that a refrigerant flow entering the condenser via the refrigerant inlet passes over the condenser tube bundle before exiting the condenser at the condenser drain. Two or more condenser ballast volumes are located in the condenser shell between the tube bundle and the condenser drain. The two or more condenser ballast volumes are spaced apart to define a channel therebetween. A condenser ballast volume of the two or more condenser ballast volumes has a horizontal top surface.

18 Claims, 6 Drawing Sheets

(51) Int. Cl.
*F28D 7/16* (2006.01)
*F28D 21/00* (2006.01)

(52) U.S. Cl.
CPC ... *F25B 2339/044* (2013.01); *F25B 2339/046* (2013.01); *F25B 2339/047* (2013.01); *F25B 2400/16* (2013.01); *F25B 2500/01* (2013.01); *F25B 2600/05* (2013.01); *F28D 2021/007* (2013.01)

(58) Field of Classification Search
USPC ..... 62/509
See application file for complete search history.

(56) References Cited

U.S. PATENT DOCUMENTS

| | | | | |
|---|---|---|---|---|
| 2,919,903 | A | 1/1960 | Vautrain et al. | |
| 3,083,763 | A | 4/1963 | Brown, Jr. | |
| 5,509,466 | A * | 4/1996 | McQuade | F25B 39/04 165/113 |
| 6,125,652 | A | 10/2000 | Vogel et al. | |
| 6,276,442 | B1 | 8/2001 | Rasmussen | |
| 6,868,689 | B1 | 3/2005 | McNeil et al. | |
| 7,784,295 | B2 | 8/2010 | McCormick et al. | |
| 9,212,836 | B2 | 12/2015 | Welch | |
| 9,677,795 | B2 | 6/2017 | Hartfield et al. | |
| 2015/0114817 | A1 | 4/2015 | Kontu | |
| 2015/0247658 | A1 | 9/2015 | Cosby, II et al. | |
| 2015/0330685 | A1 | 11/2015 | Goel | |
| 2017/0176066 | A1 | 6/2017 | Schreiber et al. | |
| 2017/0336096 | A1 * | 11/2017 | Groen | F28F 17/005 |

FOREIGN PATENT DOCUMENTS

| | | | |
|---|---|---|---|
| GB | 1422082 | A | 1/1976 |
| WO | 2016020163 | A1 | 2/2016 |

* cited by examiner

CHANNELED CONDENSER BALLAST

CROSS-REFERENCE TO RELATED APPLICATIONS

This application claims the benefit of U.S. Provisional Application No. 62/613,261, filed Jan. 3, 2018, which is incorporated herein by reference in its entirety.

BACKGROUND

Exemplary embodiments pertain to the art of heating, ventilation, air conditioning, and refrigeration (HVAC&R) systems. More specifically, the subject matter disclosed herein relates to condensers for HVAC&R systems.

HVAC&R systems, for example, chillers, utilize a refrigerant loop including a condenser, in which a flow of fluid, for example, water is urged through condenser tubes in a condenser shell for thermal energy exchange with a volume of refrigerant (refrigerant charge) in the condenser shell. Refrigerant charge in shell and tube condensers can largely be determined by the depth of refrigerant liquid at the bottom of the condenser shell. In many systems, the refrigerant liquid is driven from the condenser shell to an expansion device primarily by gravity. It is desired to reduce an amount of refrigerant charge necessary at the condenser shell in order to maintain a selected rate of liquid refrigerant drainage from the condenser shell to the expansion device to realize cost and regulatory advantages.

BRIEF DESCRIPTION

In one embodiment, a condenser for a heating, ventilation, air conditioning and refrigeration system includes a condenser shell, a refrigerant inlet located at the condenser shell, and a condenser drain located at the condenser shell. A condenser tube bundle is located in the condenser shell such that a refrigerant flow entering the condenser via the refrigerant inlet passes over the condenser tube bundle before exiting the condenser at the condenser drain. Two or more condenser ballast volumes are located in the condenser shell between the tube bundle and the condenser drain. The two or more condenser ballast volumes are spaced apart to define a channel therebetween. A condenser ballast volume of the two or more condenser ballast volumes has a horizontal top surface.

Additionally or alternatively, in this or other embodiments the two or more condenser ballast volumes are rectangular cuboids.

Additionally or alternatively, in this or other embodiments the two or more condenser ballast volumes are spaced apart along one or more of a condenser length or a condenser width.

Additionally or alternatively, in this or other embodiments the channel is a constant width and/or depth.

Additionally or alternatively, in this or other embodiments a condenser ballast volume of the two or more condenser ballast volumes tapers along its length or width.

Additionally or alternatively, in this or other embodiments a condenser ballast volume of the two or more condenser ballast volumes includes one or more steps downward from the horizontal top surface.

Additionally or alternatively, in this or other embodiments flow of the refrigerant through the condenser drain is driven by gravity.

Additionally or alternatively, in this or other embodiments the condenser drain is located at a vertical bottom of the condenser shell.

Additionally or alternatively, in this or other embodiments the two or more condenser ballast volumes are identical.

Additionally or alternatively, in this or other embodiments a subcooler is located in the condenser shell between the condenser ballast volumes and the condenser drain, such that the refrigerant flow exiting the condenser ballast volumes flows across the subcooler prior to flowing through the condenser drain.

In another embodiment, a heating, ventilation, air conditioning and refrigeration system includes a compressor and a condenser. The condenser includes a condenser shell, a refrigerant inlet located at the condenser shell to receive a refrigerant flow from the compressor and a condenser drain located at the condenser shell. A condenser tube bundle is located in the condenser shell such that a refrigerant flow entering the condenser via the refrigerant inlet passes over the condenser tube bundle before exiting the condenser at the condenser drain. Two or more condenser ballast volumes are located in the condenser shell between the tube bundle and the condenser drain. The two or more condenser ballast volumes are spaced apart to define a channel therebetween. A condenser ballast volume of the two or more condenser ballast volumes has a horizontal top surface. An expansion device receives the refrigerant flow from the condenser drain.

Additionally or alternatively, in this or other embodiments the two or more condenser ballast volumes are rectangular cuboids.

Additionally or alternatively, in this or other embodiments the two or more condenser ballast volumes are spaced apart along one or more of a condenser length or a condenser width.

Additionally or alternatively, in this or other embodiments the channel is a constant width and/or depth.

Additionally or alternatively, in this or other embodiments a condenser ballast volume of the two or more condenser ballast volumes tapers along its length or width.

Additionally or alternatively, in this or other embodiments a condenser ballast volume of the two or more condenser ballast volumes includes one or more steps downward from the horizontal top surface.

Additionally or alternatively, in this or other embodiments flow of the refrigerant through the condenser drain to the expansion device is driven by gravity.

Additionally or alternatively, in this or other embodiments the condenser drain is disposed at a vertical bottom of the condenser shell.

Additionally or alternatively, in this or other embodiments the two or more condenser ballast volumes are identical.

Additionally or alternatively, in this or other embodiments a subcooler is located in the condenser shell between the condenser ballast volumes and the condenser drain, such that the refrigerant flow exiting the condenser ballast volumes flows across the subcooler prior to flowing through the condenser drain.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
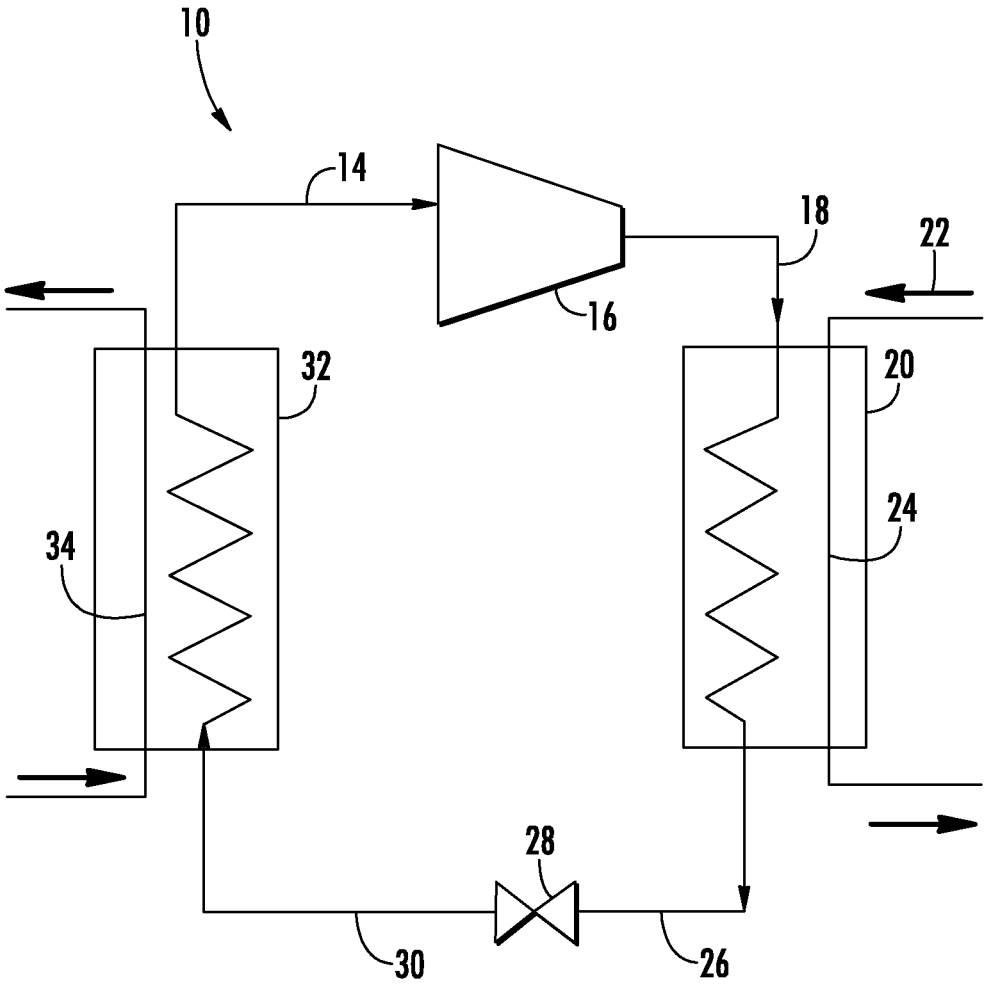
FIG. 1 is schematic view of an embodiment of a heating, ventilation, air conditioning and refrigeration (HVAC&R) system.

Shown in FIG. 1 is a schematic view of an embodiment of a heating, ventilation, air conditioning and refrigeration (HVAC&R) system, for example, a chiller 10. In the chiller 10, a flow of vapor refrigerant 14 is directed into a compressor 16, which compresses the vapor refrigerant 14 to a higher pressure and higher temperature. The compressed vapor refrigerant 18 is directed from the compressor 16 to a condenser 20. At the condenser 20, the compressed vapor refrigerant 18 exchanges thermal energy with a first thermal exchange medium 22 flowing through a condenser tube bundle, schematically shown at 24. In some embodiments, the first thermal exchange medium 22 is water, but it is to be appreciated that other liquids, such as glycol or the like may be utilized. The compressed vapor refrigerant 18 is cooled and condensed, with thermal energy rejected from the compressed vapor refrigerant 18 to the thermal exchange fluid 22.

Condensed liquid refrigerant 26 exits the condenser 20 and flows to an expansion device 28, which in some embodiments is an expansion valve, where the liquid refrigerant 26 undergoes a reduction in pressure, resulting in flash evaporation of at least a portion of the liquid refrigerant 26, such that a liquid and vapor refrigerant flow 30 exits the expansion device 28 and is directed to an evaporator 32. At the evaporator 32, the refrigerant flow 30 exchanged thermal energy with a second thermal energy transfer medium 34 to cool the second thermal energy transfer medium 34. Vapor refrigerant 14 is then directed from the evaporator 32 to the compressor 16 to complete the cycle.

Figure 2:
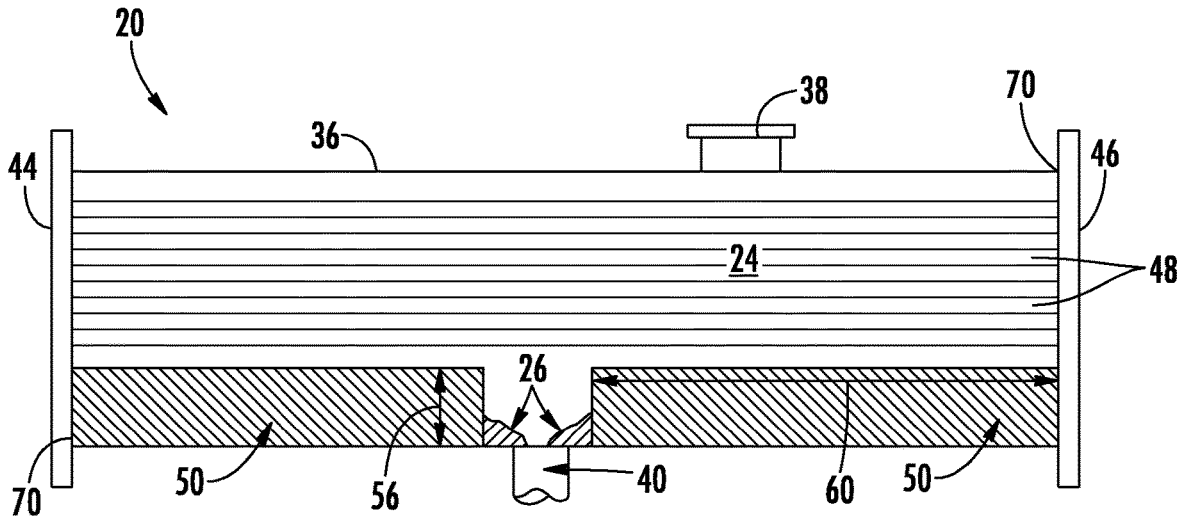
FIG. 2 is a cross-sectional side view of an embodiment of a condenser for an HVAC&R system.

Referring now to FIG. 2, an embodiment of a condenser 20 is illustrated. The condenser 20 includes a condenser shell 36, which in some embodiments is substantially cylindrical in shape. A vapor inlet 38 is disposed in the condenser shell 36 through which the compressed vapor refrigerant 18 enters the condenser 20. Further, a drain 40 is located in the condenser shell 36 through which the condensed liquid refrigerant 26 exits the condenser 20. In some embodiments, the drain 40 is located at a bottom of the condenser shell 36 such that the condensed liquid refrigerant 26 is urged through the drain 40 and toward the expansion device 28 via gravity. The condenser tube bundle 24 extends through the condenser 20. In some embodiments, the tube bundle 24 extends through a first end cap 44 and a second end cap 46 of the condenser shell 36. The condenser tube bundle 24 comprises a plurality of condenser tubes 48, through which the first thermal exchange medium 22 flows to exchange thermal energy with the compressed vapor refrigerant 18 resulting in the condensed liquid refrigerant 26.

One or more ballast volumes 50 are located in a bottom region of the condenser shell 36 below the condenser tube bundle 24 and between the condenser tube bundle 24 and the drain 40 to occupy at least a portion of the condenser shell 36 volume below the condenser tube bundle 24. The ballast volumes 50 may be, for example, sealed volumes and/or vapor-filled volumes. The ballast volumes 50 act to displace condensed liquid refrigerant 26 from the portions of the condenser shell 36 occupied by the ballast volumes 50.

Figure 3:
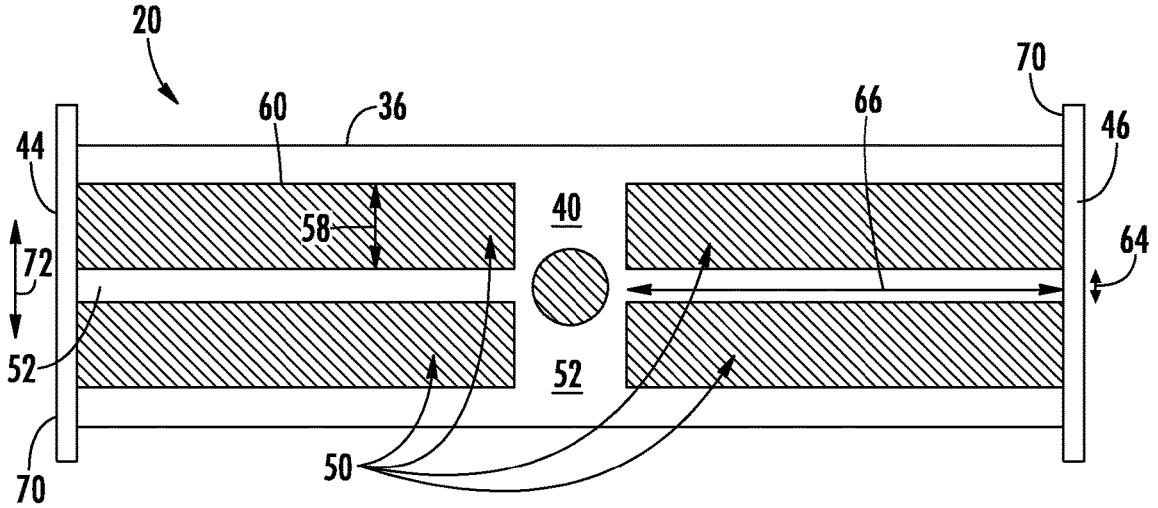
FIG. 3 is a cross-sectional top view of an embodiment of a condenser for an HVAC&R system.

Referring to FIG. 3, shown is a cross-sectional view of the condenser 20 looking downward toward the drain 40. The ballast volumes 50 are configured and arranged to define one or more gaps or channels 52 between adjacent ballast volumes 50. The channels 52 allow the condensed liquid refrigerant level 54, shown best in FIG. 4, which provides head pressure, to rise sufficiently to drive drainage flow through the drain 40 and to the expansion device 28 without accumulating large amounts of condensed liquid refrigerant 26 (refrigerant charge).

Figure 4:
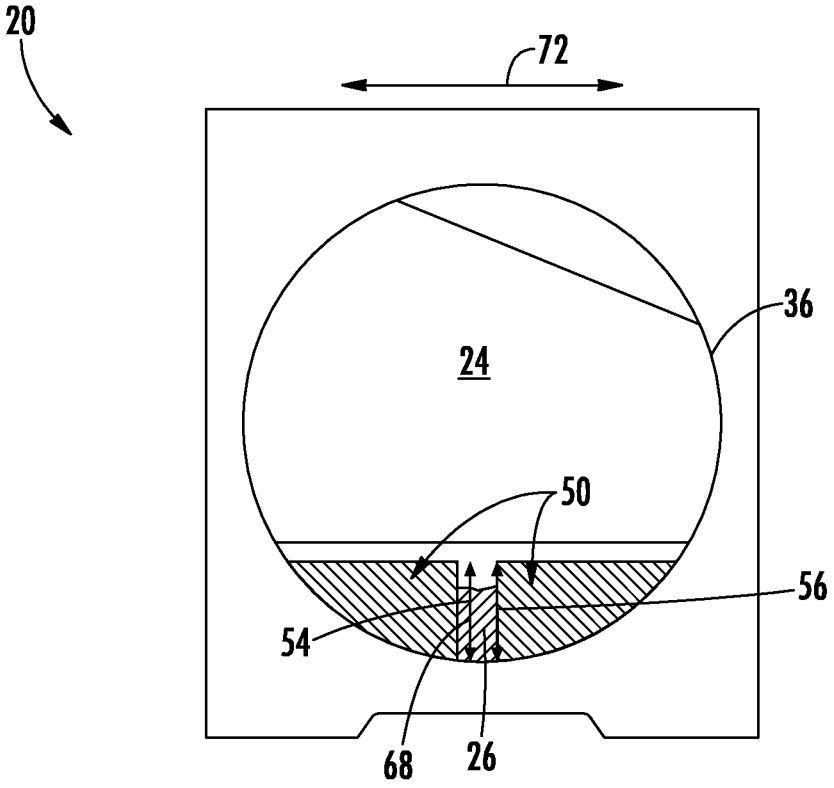
FIG. 4 is a cross-sectional end view of an embodiment of a condenser for an HVAC&R system.

As shown in FIGS. 2-4, in some embodiments the ballast volumes 50 are rectangular cuboids, having a constant height 56 defined by a horizontal top surface, a constant width 58 and a constant length 60, such that the channels 52 have a constant channel width 64, a constant channel length 66 and a constant channel height 68. In some embodiments, such as shown, the condenser 20 includes four ballast volumes 50, which are of equal size and shape. The ballast volumes 50 are arranged in a symmetric arrangement in the condenser shell 36, and are located at longitudinal ends 70 of the condenser shell 36, and are spaced apart along a lateral direction 72 of the condenser shell 36. It is to be appreciated, however, that in other embodiments, the ballast volumes 50 may be of unequal sizes and shapes, and/or may be arrayed non-symmetrically in the condenser shell 36, such as when the drain 40 is not located at a bottom center of the condenser shell 36.

Figure 5:
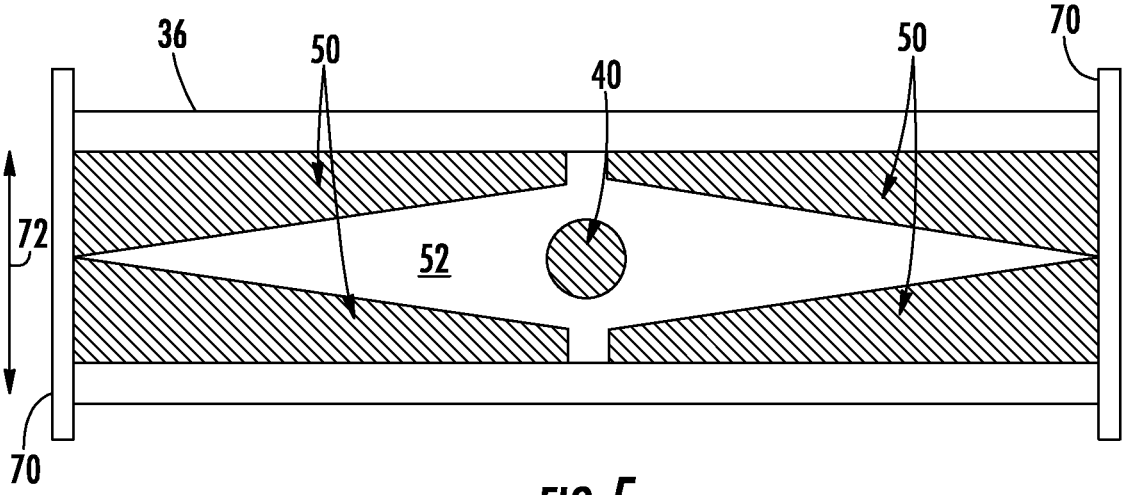
FIG. 5 is a cross-sectional top view of an embodiment of a condenser for an HVAC&R system having tapered ballast volumes.
Figure 6:
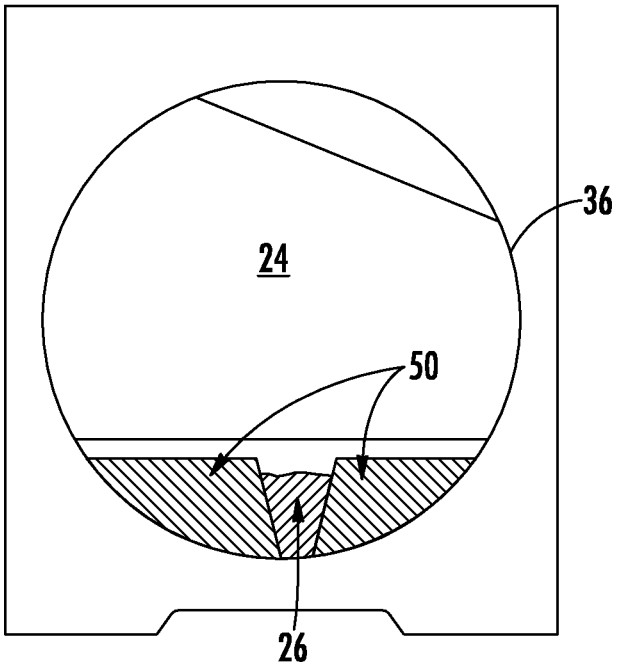
FIG. 6 is a cross-sectional end view of an embodiment of a condenser for an HVAC&R system having tapered ballast volumes.

While in the embodiments of FIGS. 2-4, the ballast volumes 50 are rectangular cuboids, it is to be appreciated that in other embodiments the ballast volumes 50 may have other shapes. For example, as shown in FIGS. 5 and 6, the ballast volumes 50 may be triangular in the lengthwise and widthwise directions, and having a constant height 56.

Figure 7:
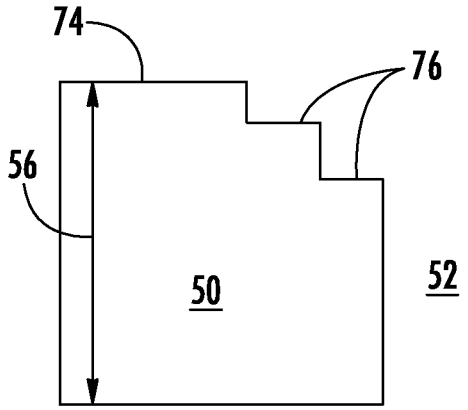
FIG. 7 is a cross-sectional view illustrating an embodiment of a stepped condenser ballast.
Figure 8:
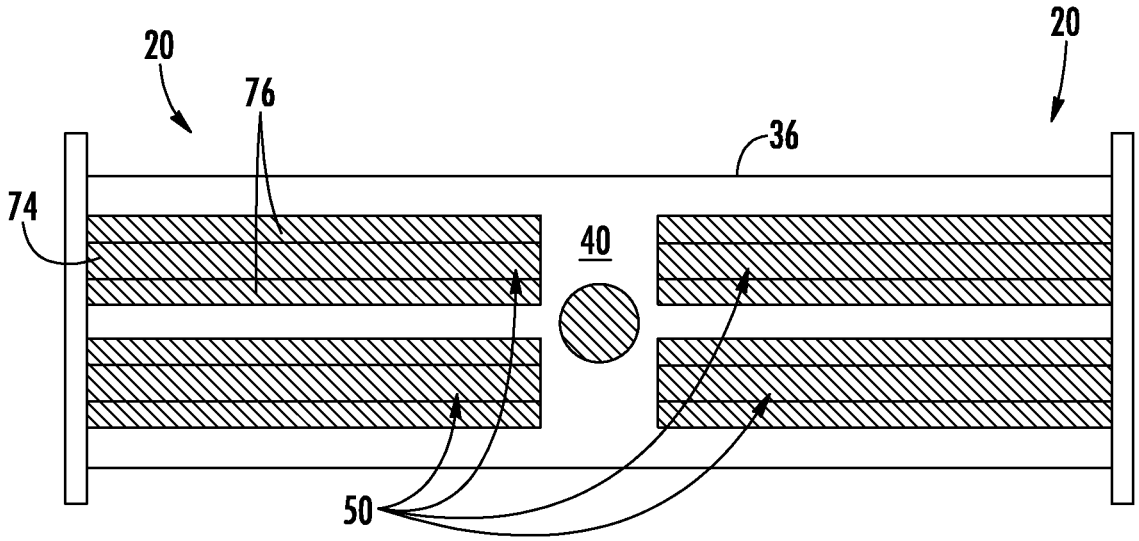
FIG. 8 is a cross-sectional top view illustrating an embodiment of a condenser with stepped condenser ballast volumes.

Referring now to FIG. 7, in other embodiments, one or more of the ballast volumes 50 may have a stepped configuration, such that a ballast top 74 defines a maximum height of the ballast volume 50. One or more steps 76 are included in the ballast volume 50 into the channel 52. In some embodiments, two steps 76 are provided, while in other embodiments other quantities of steps, such as one or three steps are included in the ballast volume 50. In some embodiments, such as shown in FIG. 7, a step 76 is included at one side of the ballast volume 50. In other embodiments, however, such as shown in FIG. 8, steps 76 may be disposed at two or more sides of the ballast volume 50.

Figure 9:
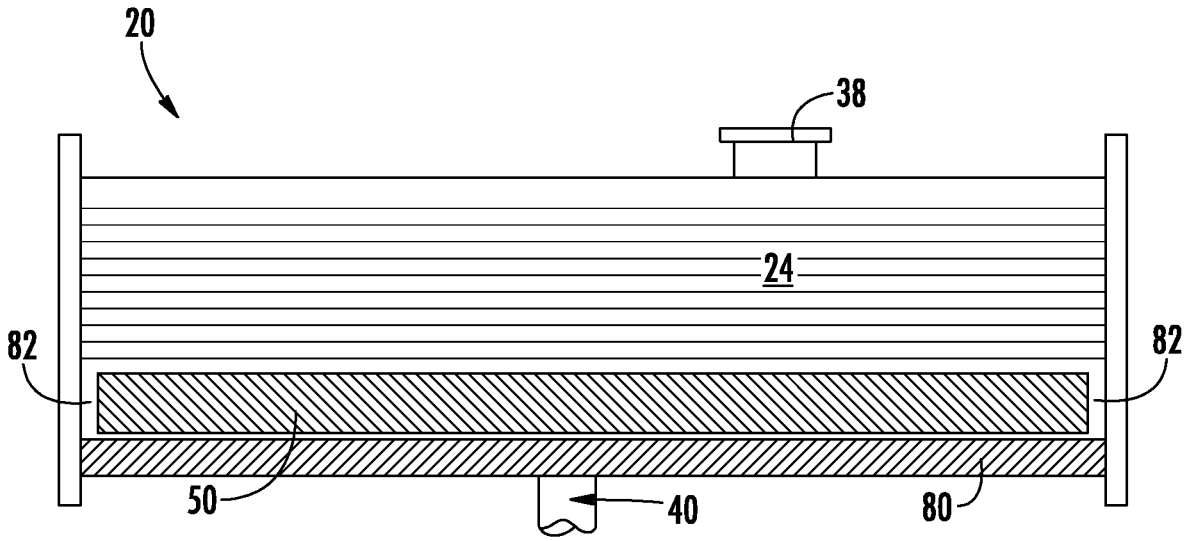
FIG. 9 is a cross-sectional view of an embodiment of a condenser including a subcooler.
Figure 10:
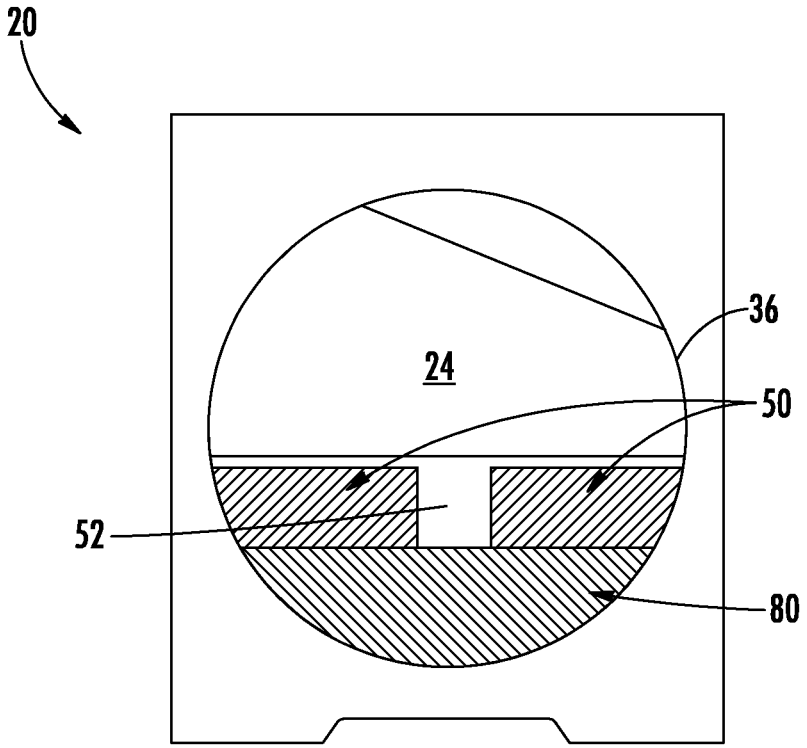
FIG. 10 is a cross-sectional end view of an embodiment of a condenser including a subcooler.

In another embodiment, such as shown in FIG. 9 and FIG. 10, the condenser 20, may include an integral subcooler 80 disposed in the condenser shell 36, vertically between the ballast volume 50 and the drain 40. The integral subcooler 80 may be a flash subcooler or a sensible subcooler. The integral subcooler 80 is positioned such that condensed liquid refrigerant 26 exiting channel 52 enters one or more subcooler inlets 82 of the subcooler 80. The condensed liquid refrigerant 26 is subcooled at the integral subcooler 80 and then exits the condenser 20 via the drain 40.

The condensers 20 including ballast volumes 50 as in the present disclosure reduces a condensed liquid refrigerant 26 charge in the condenser shell 36 while maintaining a selected head pressure for drainage flow of the condensed liquid refrigerant 26 from the condenser 20 to the expansion device 28. Reduction of the condensed liquid refrigerant 26 charge reduces HVAC&R system 10 cost, and provide regulatory benefits by reducing calculated greenhouse gas (GHG) and $CO_2$-equivalent ($CO_2e$) emissions from the HVAC&R system 10.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A condenser for a heating, ventilation, air conditioning and refrigeration system, comprising:
- a condenser shell;
- a refrigerant inlet disposed at the condenser shell;
- a condenser drain disposed at the condenser shell;
- a condenser tube bundle disposed in the condenser shell such that a refrigerant flow entering the condenser via the refrigerant inlet passes over the condenser tube bundle before exiting the condenser at the condenser drain; and
- two or more condenser ballast volumes disposed in the condenser shell between the tube bundle and the condenser drain, the two or more condenser ballast volumes spaced apart to define a channel therebetween, a condenser ballast volume of the two or more condenser ballast volumes having a horizontal top surface;
- wherein the two or more condenser ballast volumes are rectangular cuboids.

2. The condenser of claim 1, wherein the two or more condenser ballast volumes are spaced apart along a condenser width.

3. The condenser of claim 1, wherein the channel is a constant width and/or depth.

4. The condenser of claim 1, wherein a condenser ballast volume of the two or more condenser ballast volumes tapers along its length or width.

5. The condenser of claim 1, wherein a condenser ballast volume of the two or more condenser ballast volumes includes one or more steps downward from the horizontal top surface.

6. The condenser of claim 1, wherein the two or more condenser ballast volumes are identical.

7. The condenser of claim 1, further comprising a subcooler disposed in the condenser shell between the condenser ballast volumes and the condenser drain, such that the refrigerant flow exiting the condenser ballast volumes flows across the subcooler prior to flowing through the condenser drain.

8. The condenser of claim 1, wherein flow of the refrigerant through the condenser drain is driven by gravity.

9. The condenser of claim 8, wherein the condenser drain is disposed at a vertical bottom of the condenser shell.

10. A heating, ventilation, air conditioning and refrigeration system, comprising:
- a compressor;
- a condenser, including:
  - a condenser shell;
  - a refrigerant inlet disposed at the condenser shell to receive a refrigerant flow from the compressor;
  - a condenser drain disposed at the condenser shell;
  - a condenser tube bundle disposed in the condenser shell such that a refrigerant flow entering the condenser via the refrigerant inlet passes over the condenser tube bundle before exiting the condenser at the condenser drain; and
  - two or more condenser ballast volumes disposed in the condenser shell between the tube bundle and the condenser drain, the two or more condenser ballast volumes spaced apart to define a channel therebetween, a condenser ballast volume of the two or more condenser ballast volumes having a horizontal top surface; and
- an expansion device to which the refrigerant flow is directed from the condenser drain;
- wherein the two or more condenser ballast volumes are rectangular cuboids.

11. The heating, ventilation, air conditioning and refrigeration system of claim 10, wherein the two or more condenser ballast volumes are spaced apart along a condenser width.

12. The heating, ventilation, air conditioning and refrigeration system of claim 10, wherein the channel is a constant width and/or depth.

13. The heating, ventilation, air conditioning and refrigeration system of claim 10, wherein a condenser ballast volume of the two or more condenser ballast volumes tapers along its length or width.

14. The heating, ventilation, air conditioning and refrigeration system of claim 10, wherein a condenser ballast volume of the two or more condenser ballast volumes includes one or more steps downward from the horizontal top surface.

15. The heating, ventilation, air conditioning and refrigeration system of claim 10, wherein the two or more condenser ballast volumes are identical.

16. The heating, ventilation, air conditioning and refrigeration system of claim 10, further comprising a subcooler disposed in the condenser shell between the condenser ballast volumes and the condenser drain, such that the refrigerant flow exiting the condenser ballast volumes flows across the subcooler prior to flowing through the condenser drain.

17. The heating, ventilation, air conditioning and refrigeration system of claim 10, wherein flow of the refrigerant through the condenser drain to the expansion device is driven by gravity.

18. The heating, ventilation, air conditioning and refrigeration system of claim 17, wherein the condenser drain is disposed at a vertical bottom of the condenser shell.

* * * * *